US006056616A

United States Patent [19]

Bushman

[11] Patent Number: 6,056,616

[45] Date of Patent: May 2, 2000

[54] FLYING BALL

[76] Inventor: Earl K. Bushman, 13918 E. Mississippi Ave. No. 320, Aurora, Colo. 80012

[21] Appl. No.: 09/245,478

[22] Filed: Feb. 5, 1999

[51] Int. Cl.[7] ..... A63H 27/00; A63B 43/00

[52] U.S. Cl. ..... 446/61; 446/93; 473/569; 473/613

[58] Field of Search ..... 446/34, 61, 66, 446/93, 94; 473/578, 569, 582–585, 595, 613, 614, FOR 166; D21/436, 438, 714

[56] References Cited

U.S. PATENT DOCUMENTS

| | | | |
|---|---|---|---|
| 1,615,986 | 2/1927 | Knight | 446/489 |
| 1,818,426 | 8/1931 | Norcross . | |
| 3,424,460 | 1/1969 | Simpson . | |
| 4,714,444 | 12/1987 | Rendel | 446/61 |
| 5,741,168 | 4/1998 | Chen | 446/66 |
| 5,779,576 | 7/1998 | Smith, III et al. | 473/570 |
| 5,785,571 | 7/1998 | Camp | 446/124 |
| 5,807,198 | 9/1998 | Grimm | 473/613 |
| 5,928,049 | 7/1999 | Hudson | 446/4 |

*Primary Examiner*—Robert A. Hafer
*Assistant Examiner*—Laura Fossum
*Attorney, Agent, or Firm*—Allen A. Dicke, Jr.

[57] ABSTRACT

The flying ball of this invention is a solid foamed synthetic polymer composition ball having an opening therethrough in which is engaged a solid foamed fuselage so that the ball can be moved front and back on the fuselage. The ball carries wings, and the fuselage carries tail surfaces, both preferably of solid foamed polymer material.

20 Claims, 2 Drawing Sheets

FLYING BALL

FIELD OF THE INVENTION

This invention is directed to toys, and particularly toys which can be thrown, such as a ball having wings and a tail so the ball is hand-propelled and is without rotation.

BACKGROUND OF THE INVENTION

In many sports and games, balls are used to be hit, carried or thrown. These balls, particularly when thrown, are subjected to a spin which stabilizes flight. However, considerable skill is required to impart the spin to achieve stability without also introducing spin forces which produce pitch or yaw. The flying ball of this invention has aerodynamic forces thereon which guide the ball toward long and uniform flight.

SUMMARY OF THE INVENTION

In order to aid in the understanding of this invention, it can be stated in essentially summary form that it is directed to a ball which has attached thereto aerodynamic surfaces, which provide lift and stability to the flight of the ball.

It is a purpose and advantage of this invention to provide a ball which has aerodynamic surfaces thereon including wings and a tail, which provide stability and longevity to the flight of the ball.

It is another purpose and advantage of this invention to provide a ball which is sufficiently soft to be safely thrown so that injuries to others in its path will be minimized.

It is another purpose and advantage of this invention to provide a flying ball which has aerodynamic lift and control surfaces which can be adjusted to choose the type of flight path of the ball.

Other purposes and advantages of this invention will become apparent from a study of the following portions of the specification, the claims and the attached drawings.

DESCRIPTION OF THE PREFERRED EMBODIMENTS

Figure 1:
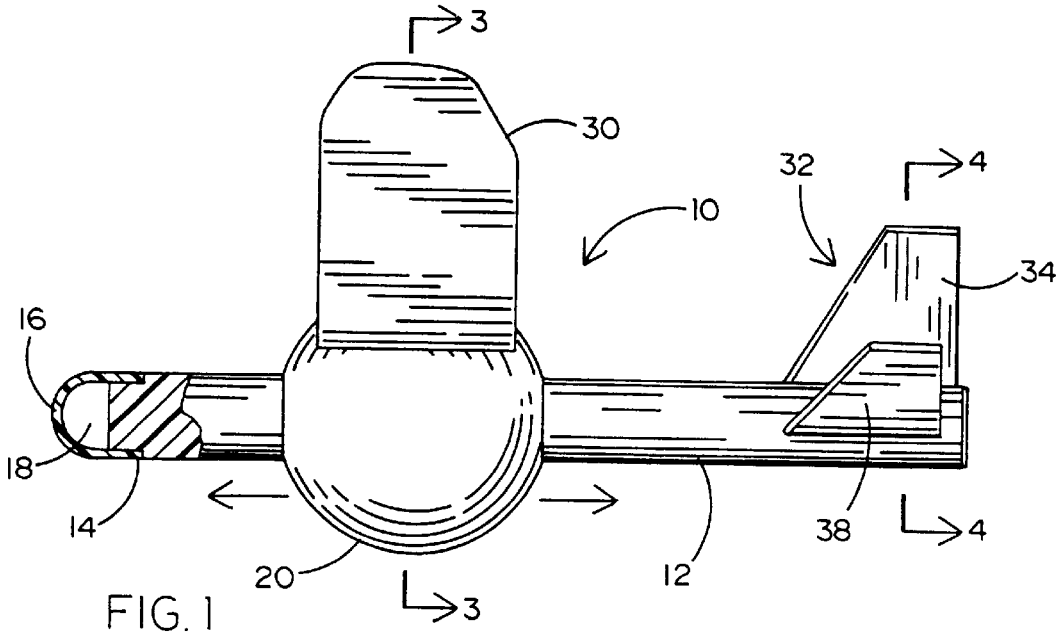
FIG. 1 is a side-elevational view of the first preferred embodiment of the flying ball of this invention, with parts broken away and parts taken in section.

The first preferred embodiment of the flying ball of this invention is generally indicated at 10 in FIG. 1. The flying ball 10 has a central cylindrical fuselage 12. The fuselage is made of soft, light, firm foamed synthetic polymer composition material and is "solid" in the sense that it does not have a central opening therethrough. The forward end of the fuselage has a shoulder 14, which is of reduced diameter and which forms a stop. Cap 16 is a soft thin wall rubber cap which fits on the front of the fuselage and against the shoulder to define an air space 18 under the cap. The cap is sufficiently soft so that, if the fuselage hits someone, it does not cause harm.

Figure 3:
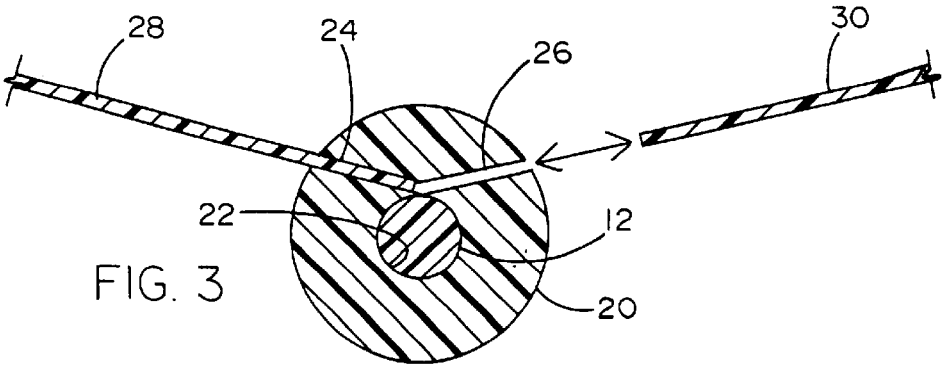
FIG. 3 is a section taken generally along line 3—3 of FIG. 1, showing one of the wings in projected position.
Figure 4:
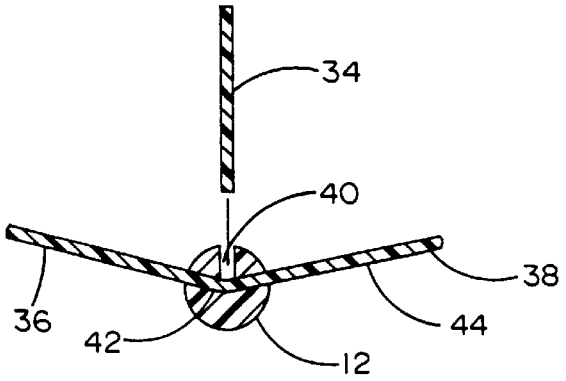
FIG. 4 is a section taken generally along line 4—4 of FIG. 1, showing one of the tail sections in projected position.

Ball 20 has an interior hole 22, see FIG. 3, through which the cylindrical fuselage 12 is slidable. The ball is also made of foamed synthetic polymer composition material and, while the materials are chosen to be as firm as possible, they are also chosen to be light. Thus, the ball is somewhat flexible. When the ball is placed on a fuselage, it can be adjusted fore and aft on the fuselage, as seen in FIG. 1. However, it is designed to stay in place unless a significant adjusting force is employed. As seen in FIGS. 1 and 3, the ball 20 is spherical. The cylindrical fuselage 12 defines a fore and aft axis, and the diametric interior hole 22 in the ball is also a cylinder about this axis.

Wing slots 24 and 26 are formed in the ball, as seen in FIG. 3. The wing slots 24 and 26 are planar with the planes being parallel to the axis of the fuselage and the ball. The two wing slots preferably have dihedral, as shown in FIG. 3, so that the wings 28 and 30 have their tips upward from a plane through the axis. The outer ends of the wings may be shaped with curves, as shown in FIG. 1, for appearance purposes. The wings are also made of a "solid" foamed synthetic polymer composition material and are sized so that they can slide into the wing slots during assembly and be retained therein with or without adhesive. The wings are molded so that they have a skin thereon to have greater strength, but in cases of maximum economy can be sliced from a larger block. The wings are preferably permanently glued in place to avoid incorrect positioning thereof, or movement during flight.

The tail 32 has a vertical rudder 34 as well as two pitch control surfaces 36 and 38. The rudder and pitch control surfaces are also made of "solid" foamed synthetic polymer composition material. Slots 40, 42 and 44 are formed in the fuselage at its after end to receive the rudder and pitch control surfaces. The flying ball 10 is preferably packaged with the wings and rudder glued in place to provide a flying ball of maximum reliability, but for a ball which is easier to pack, the wings may be removable to minimize packing space. When removed from the box, the rudder and pitch control surfaces can be pressed into their respective slots. It is preferred that the fit be sufficiently tight, that they can be retained without adhesive. The ball can be moved forward and back on the fuselage to control the flight path. The flying ball 10 flies like a glider, but is much easier to hold for throwing than conventional gliders. In addition, the flying ball can be adjusted to different positions along the fuselage to create different flight patterns without adjustment of the tail or rudder.

Suitable material for use in creating the ball, the fuselage, the wings and the tail has low density, low resiliency, and a fair strength. Foamed polyvinyl chloride with a density of about 3 pounds per cubic foot is suitable. The parts can be cut from the solid so that their surfaces are that of cut open bubbles. There is no need for a skin on the parts. On the other hand, each of the parts can be foamed into a mold so as to create a skin on the parts. This increases the strength and the life of the resultant structure.

A particular size relationship is given below as an example of suitable sizes for a useful flying ball structure. These dimensions are given as a suitable example, and these dimensions are not considered limitative. The fuselages are cylindrical and are usually at least 1 inch in diameter in order to maintain resiliency and rigidity with lengths from 10 to 12 inches. The minimum length of the wing is found by dividing the fuselage length by 0.7. A wing up to about 25 percent longer will work well. The wing span given is the total span of both wings. The width of the wings should be about 16 percent of their length. The length of the tail should be about 42 percent of the length of the wing. The width of the tail can be up 67 percent of the width of the wing. These are maximum dimensions. Reductions therefrom up to 25 percent are successful. The height of the rudder can be one-half of the length of the tail surfaces. If necessary, weights can be added to the front of the fuselage including placement within the soft nose 16.

Figure 2:
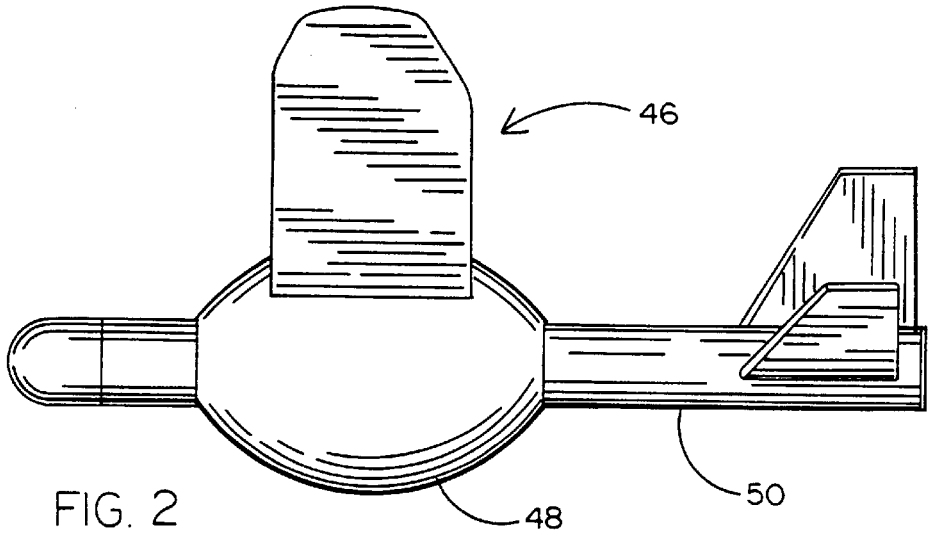
FIG. 2 is a side-elevational view of the second preferred embodiment of the ball of this invention.

The flying ball 46 seen in FIG. 2 is identical to the flying ball 10, except that its ball 48 is in the form of an oblate spheroid with its long axis on the axis of fuselage 50. The flying ball 46 is also easy to assemble and throw.

Figure 5:
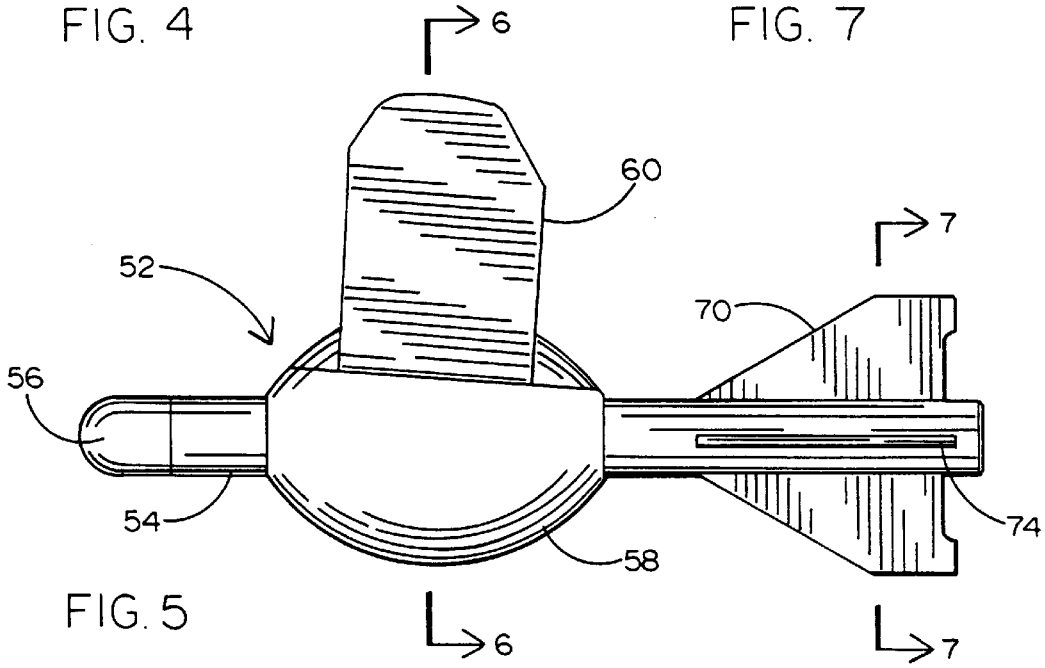
FIG. 5 is a side-elevational view of another species of the flying ball of this invention.
Figure 6:
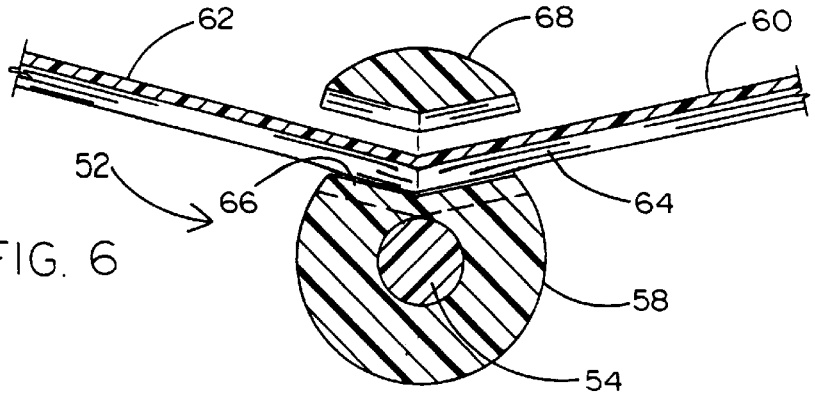
FIG. 6 is a section taken generally along line 6—6 of FIG. 5, showing a section through the ball and showing parts in projected position.

Flying ball 52 seen in FIG. 5 has a cylindrical fuselage 54 which carries a nose 56 thereon the same as nose 16. Ball 58 is illustrated as being an oblate spheroid like a football, although a spherical or other ball could also be used in this flying ball structure. The ball 58 is slidable on the fuselage. Both are made of foamed synthetic polymer composition material, as previously described. Wings 60 and 62 are mounted on surfaces 64 and 66, which are not parallel to the axis of the fuselage and the ball. The surfaces 64 and 66 are planar, and the wings lie against them. The surface planes 64 and 66 intersect in a line which is closer to the axis in the rearward direction. The line of intersection between the surfaces intersects with the axis at an angle which defines the angle of attack of the wings. The angle of attack is preferably about 6 degrees. The angle of attack permits the wing to give lift to the flying ball when the flying ball is moving on the axis of the fuselage.

Cover 68 has an exterior shape such that, when the wings are adhesively attached to the surfaces 64 and 66 and the cover is adhesively attached to the wings, the exterior surface of the cover defines a continuous smooth surface with the rest of the ball. During shipping, the flying ball 52 is preferably boxed with its wings dismounted. The user assembles the flying ball in the manner described above.

Figure 7:
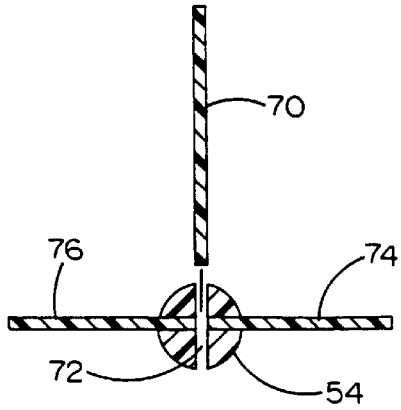
FIG. 7 is a section taken generally along line 7—7 of FIG. 5, showing one of the tail surfaces in projected position.

The tail of the flying ball has four control surfaces. As seen in FIG. 7, its rudder 70 is demounted during shipping and is assembled through slot 72 upon assembly of the flying ball. The pitch control surfaces 74 and 76 are factory assembled into corresponding slots toward the tail of the fuselage. The slot 72 is left open therebetween for user assembly of the rudder. The four surfaces of the tail each preferably extend the same distance out from the axis. The four tail surfaces are also substantially parallel to the fuselage axis.

The materials and dimensions of the flying ball 52 are substantially the same as for the flying balls 10 and 46. Theoretically, the flying balls are each the same and remain the same. However, with the use of very light foamed synthetic polymer composition material, the parts do not stay uniform, planar or straight. The fuselage can be bent easily to cause the flying ball to fly like a glider with turns, loops, dips, and return flights.

With adjustment of the various angles by bending of the foamed bodies, any one of the balls can be configured to travel with a slight rise, travel straight, or travel the arch of the normal path of a football. Furthermore, the ball can be configured to make gentle left or right turns. In order to control turns, the fuselage can be rotated within the ball. This rotates the tail with respect to the wings. Sometimes the fuselage is bent, and sometimes the tail is not uniform. This rotational adjustment can be used to adjust the flight. The flying ball is significantly different than a glider because a ball is relatively large and is easy to catch.

This invention has been described in its presently contemplated best embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A flying ball comprising:

a fuselage having a front end and a back end and having a substantially uniform cross section between its front end and its back end;

a ball having an opening therethrough, said fuselage extending through said opening and configured such that said ball embraces said fuselage and is movable forward and backward thereon between its front end and its back end;

wings mounted on said ball; and a tail mounted on said fuselage adjacent its back end, said tail mounted on said fuselage adjacent its back end, said tail comprising at least a rudder surface and a pitch control surface.

2. The flying ball of claim 1 wherein said ball and said fuselage are made of solid foamed synthetic polymer composition material.

3. The flying ball of claim 1 wherein said ball had first and second wing slots therein and said wings comprises first and second separate wings respectively frictionally engaged in said first and second wing slots.

4. The flying ball of claim 3 wherein said ball and said fuselage are made of solid foamed synthetic polymer composition material.

5. The flying ball of claim 1 wherein said tail comprises first and second pitch control slots in said fuselage adjacent its back end and first and second pitch control surfaces respectively within said slots and a rudder slot in said fuselage adjacent its back end and a rudder positioned within said rudder slot.

6. The flying ball of claim 5 wherein said rudder slot extends through said fuselage from top to bottom and said rudder is a one-piece rudder extending out of said fuselage on both the top and bottom of said fuselage.

7. The flying ball of claim 6 wherein said ball and said fuselage are made of solid foamed synthetic polymer composition material.

8. The flying ball of claim 1 wherein a resilient cap is attached to the front end of said fuselage, said resilient cap having a space therein so that said rubber cap softens the blow when said flying ball strikes an object.

9. The flying ball of claim 4 wherein said fuselage is a cylindrical solid having an axis and there are surfaces within said ball upon which said wings engage, said surfaces being planar and being parallel to said axis.

10. The flying ball of claim 4 wherein said fuselage is a cylindrical solid having an axis and there are surfaces within said ball upon which said wings engage, said surfaces being planar with the planes of said surfaces intersecting said axis behind said ball so that said wings having a positive angle of attack with respect to said axis.

11. The flying ball of claim 7 wherein said ball and said fuselage are made of solid foamed synthetic polymer composition material.

12. The flying ball of claim 11 wherein said wings are adhesively attached to said surfaces and a cover is adhesively attached to said wings, said cover having a ball surface so that when in place it continues the surface of the ball to which said wings are attached.

13. A flying ball comprising:

an elongated fuselage having a front end and a back end, said fuselage being made of solid foamed synthetic polymer composition material, said fuselage having a substantially uniform cross section between its front end and its back end;

a ball having an opening therethrough, said fuselage extending through said opening and whereby said ball embraces said fuselage, said ball being made of solid foamed synthetic polymer composition material, said ball being slidable along the length of said fuselage;

first and second wings attached to said ball and at least first, second and third tail surfaces attached to said fuselage adjacent its back end so that when said ball is thrown, it is partially aerodynamically supported by said wings and its direction controlled by said tail surfaces.

14. The flying ball of claim 13 wherein said fuselage has a substantially cylindrical exterior surface and said ball has a substantially cylindrical interior surface in said opening therethrough so that said substantially cylindrical interior surface of said ball embraces said fuselage so that said ball can move on said fuselage.

15. The flying ball of claim 14 wherein said wings and said tail surfaces are made of foamed synthetic polymer composition material.

16. The flying ball of claim 14 wherein said ball has first and second slots therein and said first and second wings are engaged in said slots and retained therein without the use of adhesive.

17. The flying ball of claim 16 wherein there are slots in said fuselage adjacent its back end and at least some of said tail surfaces are engaged in said slots without the use of adhesive.

18. The flying ball of claim 17 wherein said wings and said tail surfaces are made of foamed synthetic polymer composition material.

19. The flying ball of claim 13 wherein said ball has a wing engagement surface thereon and said wings are adhesively attached to said wing engagement surfaces and there is a cap adhesively attached to said wings above said wing engagement surfaces, said cap being configured so that its external surface is a continuation of the surface of said ball.

20. The flying ball of claim 19 wherein said surfaces define planes on said ball and said opening through said ball defines a central axis of said ball, said planes intersecting said central axis behind said ball so that said wings have a positive angle of attack when said flying ball is thrown.

* * * * *